US005826394A

United States Patent [19]

Barton, Jr. et al.

[11] Patent Number: 5,826,394

[45] Date of Patent: Oct. 27, 1998

[54] BASIC BUILDING BLOCKS FOR CONSTRUCTING COMPLEX BUILDING STRUCTURE

[75] Inventors: William M. Barton, Jr., Encinitas; Lonnie Pogue, San Diego, both of Calif.

[73] Assignee: Rokenbok Toy Company, Cardiff, Calif.

[21] Appl. No.: 752,213

[22] Filed: Nov. 19, 1996

[51] Int. Cl.[6] ..... E04B 2/08; E04B 2/18; E04B 2/32; E04B 2/46

[52] U.S. Cl. ..... 52/592.1; 52/503; 52/504; 52/505; 446/98; 446/100; 446/128; 446/188; 446/85; 446/116

[58] Field of Search ..... 52/592.1, 503, 52/504, 505; 446/116–122, 98, 100, 128, 188, 85

[56] References Cited

U.S. PATENT DOCUMENTS

| | | | |
|---|---|---|---|
| 3,205,611 | 9/1965 | Onanian . | |
| 3,415,007 | 12/1968 | Howe | 446/128 X |
| 3,545,122 | 12/1970 | Onanian . | |
| 3,651,597 | 3/1972 | Daenen . | |
| 3,993,313 | 11/1976 | Tillotson . | |
| 4,143,481 | 3/1979 | Loechel . | |
| 4,430,826 | 2/1984 | Ryaa . | |
| 4,551,110 | 11/1985 | Selvage et al. . | |
| 4,602,908 | 7/1986 | Kroeber . | |
| 4,676,762 | 6/1987 | Ballard . | |
| 4,833,856 | 5/1989 | Zwagerman . | |
| 4,895,544 | 1/1990 | Fischer | 446/124 X |
| 4,964,833 | 10/1990 | Suzuki . | |
| 5,013,245 | 5/1991 | Benedict . | |
| 5,022,885 | 6/1991 | Lyman . | |
| 5,098,328 | 3/1992 | Beerens . | |
| 5,259,803 | 11/1993 | Lyman . | |
| 5,306,198 | 4/1994 | Forman . | |
| 5,322,467 | 6/1994 | Barzani . | |
| 5,350,331 | 9/1994 | Glickman . | |
| 5,378,185 | 1/1995 | Ban . | |
| 5,458,522 | 10/1995 | Brooks, III | 446/85 |
| 5,683,283 | 11/1997 | Glynn | 446/128 |

*Primary Examiner*—Carl D. Friedman
*Assistant Examiner*—W. Glenn Edwards
*Attorney, Agent, or Firm*—Ellsworth R. Roston Fulwider Patton Lee & Utecht, LLP

[57] ABSTRACT

A hollow block (e.g. a rectangular prism) preferably has six (6) perpendicular faces. Each face preferably has a wall with a particular thickness. An opening is provided in at least a particular one of the faces, and preferably in all six (6) faces. A hollow beam (e.g. a rectangular prism) preferably has six (6) perpendicular faces. Each face is preferably defined by a wall with a particular thickness. An opening is provided in at least a particular one of the faces, and preferably in the four (4) faces defining a closed loop, in the beam. Substantially parallel snaps extend from the other two (2) beam walls and have at their outer ends portions shaped to facilitate insertion of such snaps into the opening in the particular face of the block, retention of the snaps by the inner surface of the face defining the opening and removal of the snaps from the opening. Such portions are shaped for the beams to be pulled, peeled or bent from the block. When the block has an opening in each of its six (6) faces, snaps from six (6) different beams can extend into the six (6) different openings in six (6) different directions in the block without any interference in the block from the snaps in the six (6) beams. In this way, complex structures can be formed from the blocks and the beams. Other structures such as vehicle ramps, building roofs, awnings and corbels can be disposed in a cooperative relationship with a structure formed from the blocks and the beams.

63 Claims, 6 Drawing Sheets

FIG. 3
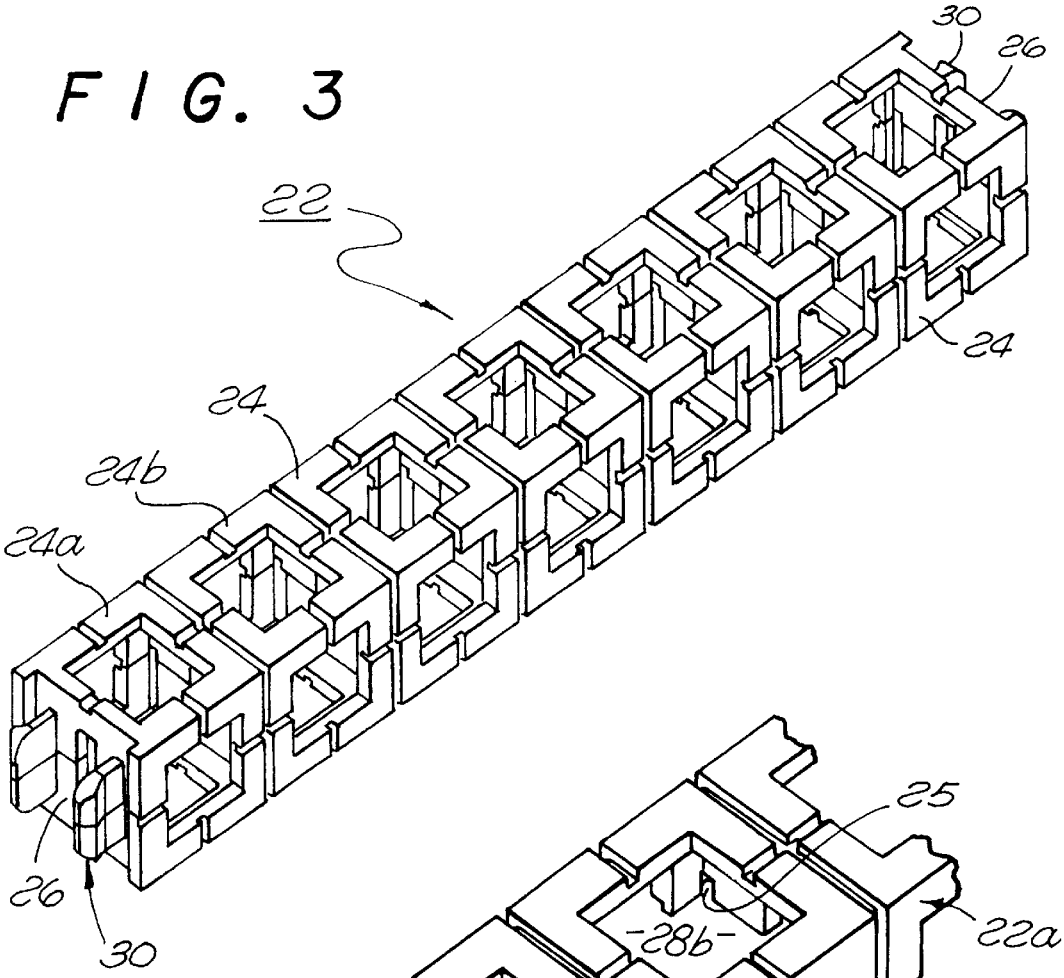
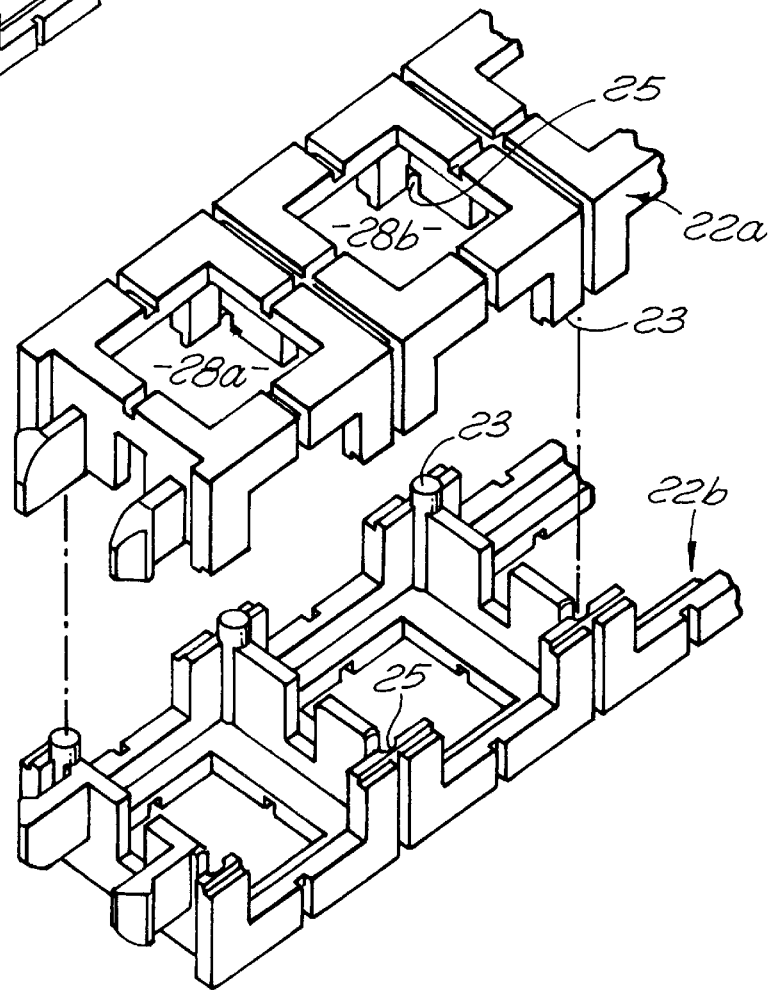
FIG. 4

BASIC BUILDING BLOCKS FOR CONSTRUCTING COMPLEX BUILDING STRUCTURE

This invention relates to building blocks and building beams forming a basic structure for forming complex edifices. The invention particularly relates to building blocks and building beams which can be assembled easily by children in toy systems to form complex structures.

BACKGROUND OF THE INVENTION

A considerable number of toy systems are now being marketed for use by children to build complex structures. The systems employ building blocks which are assembled by the children to form the structures. The building blocks in such toy systems have a number of significant disadvantages. They are expensive, not capable of being easily manipulated by the children using such blocks and relatively complicated. For example, such systems often require a number of different types of blocks to form a proper structure of any creativity. This is particularly true when the structure is extended in a number of different directions.

The building blocks of the prior art are also disadvantageous in that they have odd shapes. This prevents the building blocks from having a uniform disposition on a support surface such as a table or a floor and complicates the ability of children to form creative structures from the blocks. It also complicates the ability of the children to stack the blocks compactly in an enclosure such as a box when the blocks are not being used.

BRIEF DESCRIPTION OF THE INVENTION

This invention provides a system which overcomes the disadvantages of the systems of the prior art. For example, the system of this invention provides a single type of coupling block and a single type of beam to form complex structures involving some creativity. Furthermore, a single coupling block can operate in conjunction with a number of beams, all of the same construction, to extend the structure in six different directions along three perpendicular axes. The coupling block and the beam can be easily coupled to each other and also can be easily separated from each other. However, when the coupling block and the beam are coupled to each other, a strong and effective interrelationship exists between them.

In one embodiment of the invention, a hollow block (e.g. rectangular prism) preferably has six (6) perpendicular faces. Each face preferably has a wall with a particular thickness. An opening is provided in at least a particular one of the faces, and preferably in all six (6) faces. A hollow beam (e.g. a rectangular prism) preferably has six (6) perpendicular faces. Each face is defined by a wall with a particular thickness.

An opening is provided in at least a particular one of the faces, and preferably in the four (4) faces defining a closed loop, in the beam. Substantially parallel snaps extend from the other two (2) beam walls and have at their outer ends portions (which may be considered as "detents") shaped to facilitate insertion of such snaps into the opening in the particular face of the block, retention of the snaps by the inner surface of the face defining the opening and removal of the snaps from the opening. Such portions are shaped for the beams to be pulled, peeled or bent from the block.

When the block has an opening in each of its six (6) faces, snaps from six (6) different beams can extend into the six (6) different openings in six (6) different directions in the block without any interference in the block from the snaps in the six (6) beams. In this way, complex structures can be formed from the blocks and the beams. Other structures such as vehicle ramps, building roofs, awnings and corbels can be disposed in cooperative relationship with structure formed from the blocks and the beams.

Since the block and the beam have the shapes of rectangular prisms, they have a uniform disposition on a support surface such as a floor or a table. Furthermore, since the block preferably has six (6) faces all of substantially identical construction, children can easily assemble the snaps at either of the opposite ends of the beam into the opening in any one of the faces in the block without affecting the relationship between the block and the beam when other beams are attached to other faces of the block.

The blocks and the beams also have other advantages. Only blocks and beams are required to construct complex structures. This is in contrast to the prior art where a number of different types of members are required to construct complex structures. Furthermore, the blocks in the system of this invention constitute female members. This provides for a universality in the use of the blocks. When the blocks have openings in all six (6) of their faces, any of the faces can be coupled to one of the beams. This enhances the universality in the usage of the system in constructing creative structures of some complexity.

BRIEF DESCRIPTION OF THE DRAWINGS

In the drawings:

FIG. 3 is a perspective view of a beam which can be co-operatively coupled to the block shown in FIG. 1 to provide for the creation of complex structures when a plurality of blocks and beams are coupled to one another in original patterns;

FIG. 4 is an enlarged exploded perspective view of two (2) duplicative sections which can be combined to form the beam shown in FIG. 3;

DETAILED DESCRIPTION OF THE INVENTION

Figure 1:
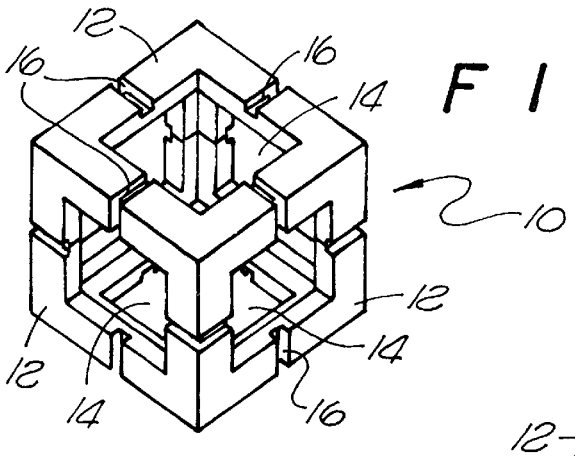
FIG. 1 is a perspective view of a block constituting one of the basic members for building a complex structure of any desired originality.
Figure 2:
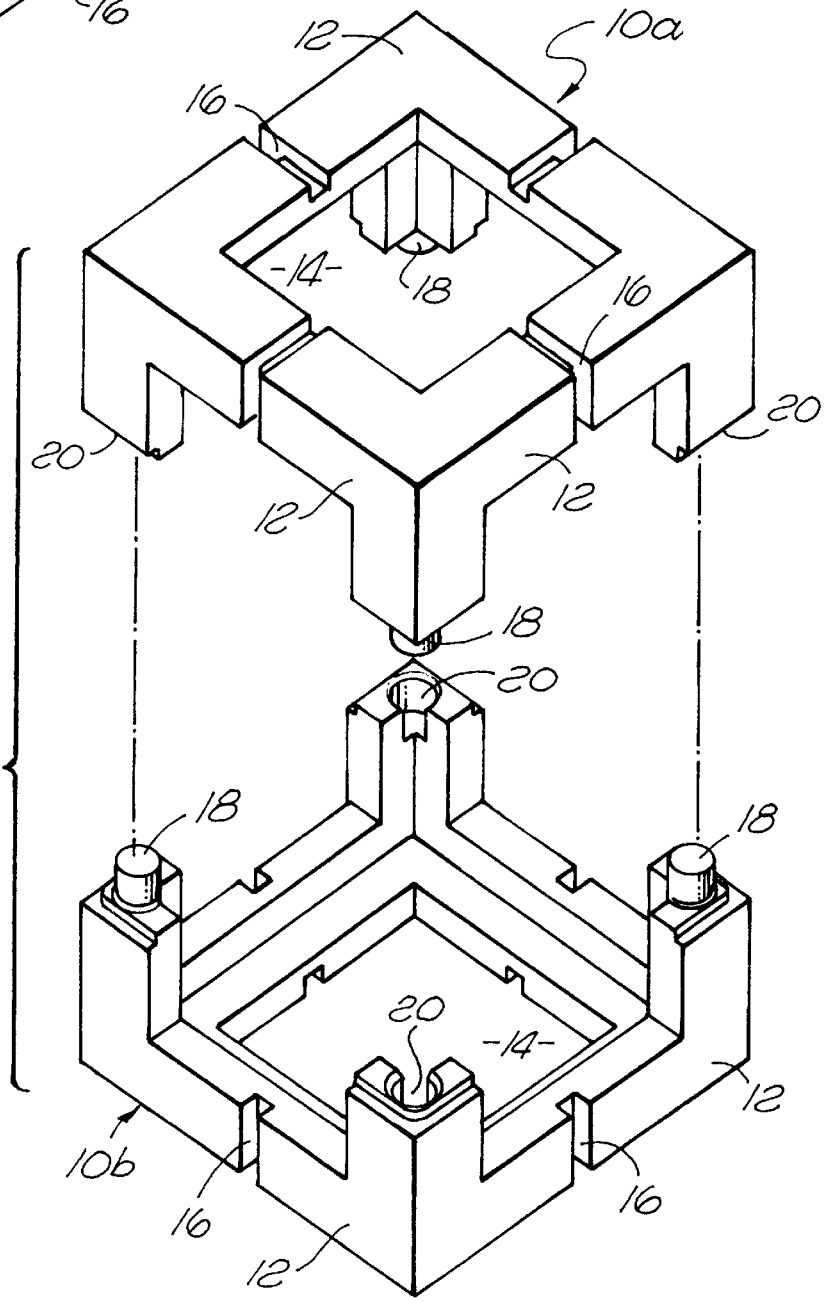
FIG. 2 is an enlarged exploded perspective view of two (2) duplicative sections which can be combined to form the block shown in FIG. 1.

In one embodiment of the invention, a hollow block generally indicated at 10 (FIGS. 1 and 2) is provided. The block 10 may be made from a suitable thermoplastic material such as an acrylonitrile-butadiene-styrene (ABS). The block may preferably be in the form of a rectangular prism with six (6) substantially identical faces 12. Each of the faces 12 may have a configuration of a square with a suitable length such as approximately twenty millimeters (20 mm) for each side of the square, a thickness of approximately two millimeters (2 mm) and a centrally disposed square opening 14 of approximately twelve millimeters (12 mm) for each side of the opening.

Openings 14 are preferably provided in each of the faces 12. It will be appreciated, however, that the opening 14 may be provided in any number of the faces from one (1) to six (6). A number of the blocks 10 may be provided with the openings 14 in only a limited number of the faces 12. Of course, limiting the number of the faces 12 with the openings 14 in the blocks 10 limits the utility which can be provided for the blocks. Grooves 16 may be provided in the faces 12 for decorative purposes.

The blocks 10 may be formed in two sections respectively designated as 10*a* and 10*b*. The sections 10*a* and 10*b* may be identical although this is not a requirement. Each of the sections 10*a* and 10*b* may be provided with pegs 18 at a pair of diagonally opposite ends of such section. Each of the sections 10*a* and 10*b* may also be provided with sockets 20 at the other pair of the diagonally opposite ends of such section. The pegs 18 on each of the sections 10*a* and 10*b* are adapted to fit snugly in the sockets 20 in the other one of the sections 10*a* and 10*b*. The sections 10*a* and 10*b* may then be joined to each other as by brazing or locally heating the pegs 18 and 20 to a temperature for melting and fusing the pegs and the sockets or they may be joined by any other method well known in the art. Alternatively, the pegs 18 may be provided in the section 10*a* and the sockets 20 may be provided in the other section 10*b*.

A beam generally indicated at 22 (FIGS. 3 and 4) is adapted to be used in conjunction with the block 10. The beam 22 may be made from a suitable thermoplastic material such as an acrylonitrile-butadiene-styrene (ABS). The beam may preferably be in the form of a rectangular prism with four (4) substantially identical faces 24 defining a rectangle in section and with two substantially identical end faces 26 in opposed relationship at the opposite ends of the faces 24.

The beam 22 may also be formed in two sections 22*a* and 22*b* in a manner similar to the formation of the block 10. For example, each of the beam sections 22*a* and 22*b* may be provided with diametrically disposed pegs 23 for each of the sections 22*a* and 22*b* and with a pair of diametrically disposed sockets 25 for receiving the pegs 23 in the other one of the beam sections 22*a* and 22*b*. After the pegs 23 in each of the sections 22*a* and 22*b* have been press fitted into the sockets 25 in the other one of the sections 22*a* and 22*b*, the two sections may be attached to each other as by brazing or by heating the pegs 23 and the sockets 25 to melt and fuse the pegs and the sockets or by any other suitable method well known in the prior art. Alternatively, the pegs 23 may be provided in the beam section 22*a* and the sockets 25 may be provided in the beam section 22*b*.

Each of the faces 24 may have a plurality of face sections 24*a*, 24*b*, etc. and a plurality of openings 28*a*, 28*b*, etc., respectively corresponding to the openings 14 in the faces 12 of the block 10. Each of the openings 28*a*, 28*b*, etc. is respectively provided in one of the face sections 24*a*, 24*b*, etc. Each of the openings 28*a*, 28*b*, etc. in the beam 22 may be substantially identical to the openings 14 in the block 10. Although seven (7) openings are shown in each of the faces 24, the number of openings in each face 24 may be different from seven (7) without departing from the scope of the invention. Furthermore, the openings 28 do not have to be provided in every face. For example, the openings 28 may be provided in only one (1) of the faces 24 without departing from the scope of the invention.

Figure 5:
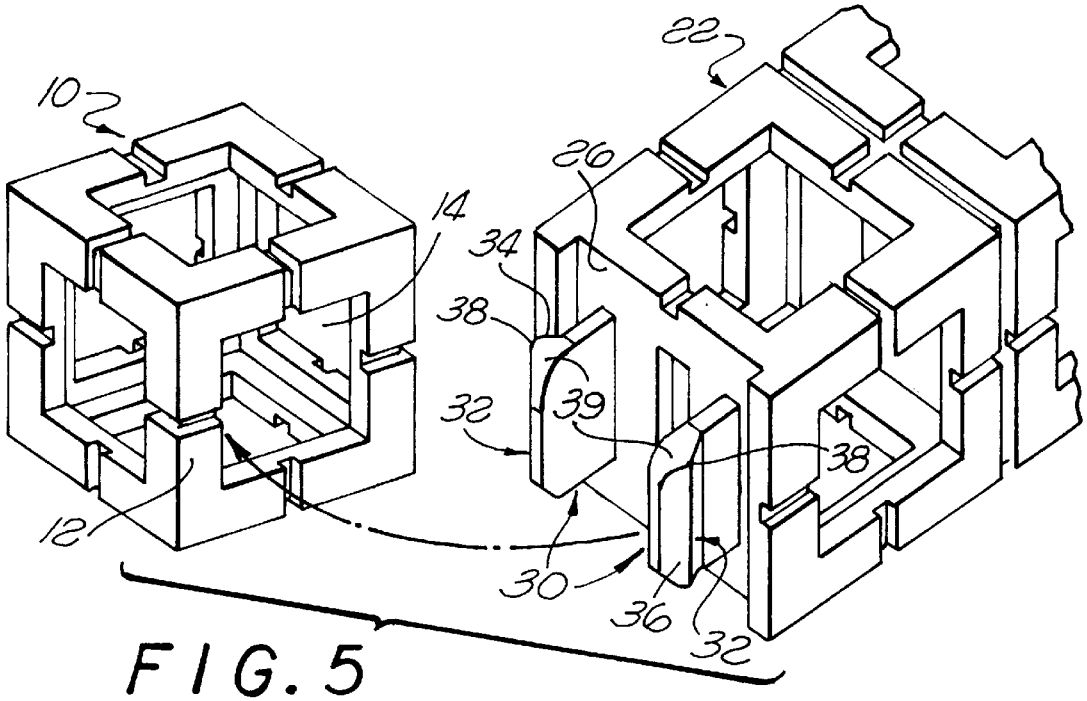
FIG. 5 is a schematic perspective view of the block and the beam in an exploded relationship and shows how the beam can be coupled to the block.
Figure 6:
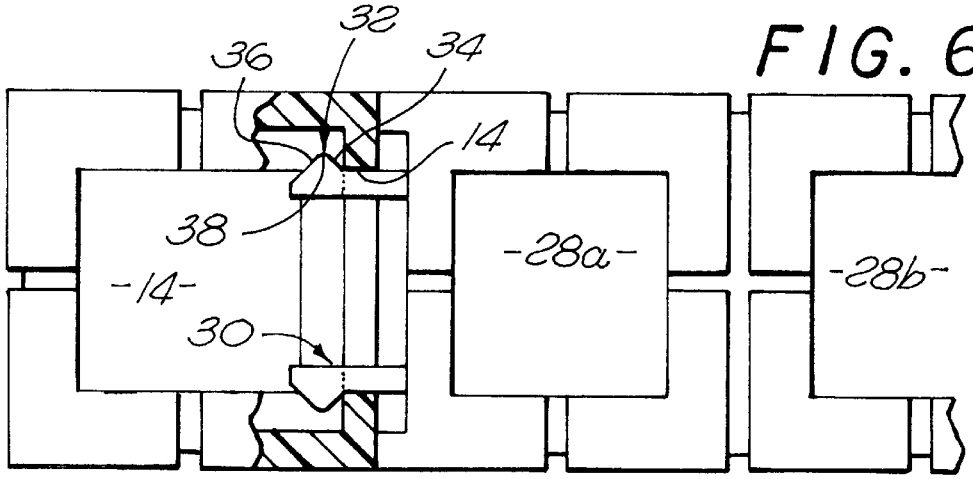
FIG. 6 is an elevational view of the block and the beam in a coupled relationship with the block partially broken away to show how the block and the beam are coupled to each other.

Snaps generally indicated at 30 are preferably provided in the two (2) end faces 26. Preferably two (2) snaps 30 extend from each of the end faces 26. The snaps 30 on each of the end faces 26 are substantially identical and are substantially parallel to each other. Each of the snaps 30 has at its outer end a portion which may be considered as a detent 32 (FIGS. 5 and 6). Each detent 32 has a first portion 34 which progressively increases in thickness with progressive distances from the end faces 26. Each of the detents 32 has a second portion 36 which progressively decreases in thickness with progressive distances from the end faces 26. The first detent portion 34 and the second detent portion 36 have a common boundary 38 at the positions of their maximum thicknesses. As will be seen, the detent portions 32 and 34 of each snap 30 have a bulbous shape.

The snaps 30 are constructed to be inserted into the openings 14 in the block 10. The progressive increase in thickness of the detent portion 36 facilitates this insertion. When the snaps 30 have been inserted into one of the openings 14, the detent portions 34 and 36 are disposed internally of the internal surface of the face 12 defining such opening. The snaps 30 may also be removed easily from the opening 14 in the face 12 by pulling the snaps outwardly from the opening. This is indicated by an arrow 37 in FIG. 7. The progressive increase in the thickness of the detent portions 34 in the snaps 30 facilitates the removal of the snaps from the opening 14.

At the positions of the detent portions 34 and 36 in each snap 30, the snap is provided with a rounded surface 39 at the opposite ends of the snap. The rounded surface 39 on each snap 30 provides for the removal of each snap from the opening 14 in the face 12 of the block 10 by bending the snap from the opening. This may be seen from FIG. 9 where the snaps 30 on one of the beams 22 have been partially bent out of the opening 14. The direction of such bending is indicated by an arrow 41 in FIG. 9. As will be appreciated, the detent portions 34 also facilitate the bending action to remove the snaps 30 from the opening 14. This bending is indicated by an arrow 43 in FIG. 8. This bending is in a direction perpendicular to the bending shown in FIG. 9. This may be seen from FIG. 8 which shows the snap 30 partially removed from the opening 14 in the block 10 as a result of the bending of the beam 22 in the direction 43.

It should be appreciated that the beam 22 does not have to be coupled to one of the openings 14 in the block 10. The beam 22 can also be coupled to one of the openings 28 in another one of the beams 22. However, the coupling of two (2) beams can occur in only one of four (4) different directions because the snaps 30 are disposed on the beams in the other two (2) directions. However, the coupling of one of the beams 22 and one of the blocks 10 can occur in any of six (6) different directions. It will thus be seen that a coupling of one of the beams 22 to one of the blocks 10 is preferable to a coupling of two (2) beams.

Figure 10:
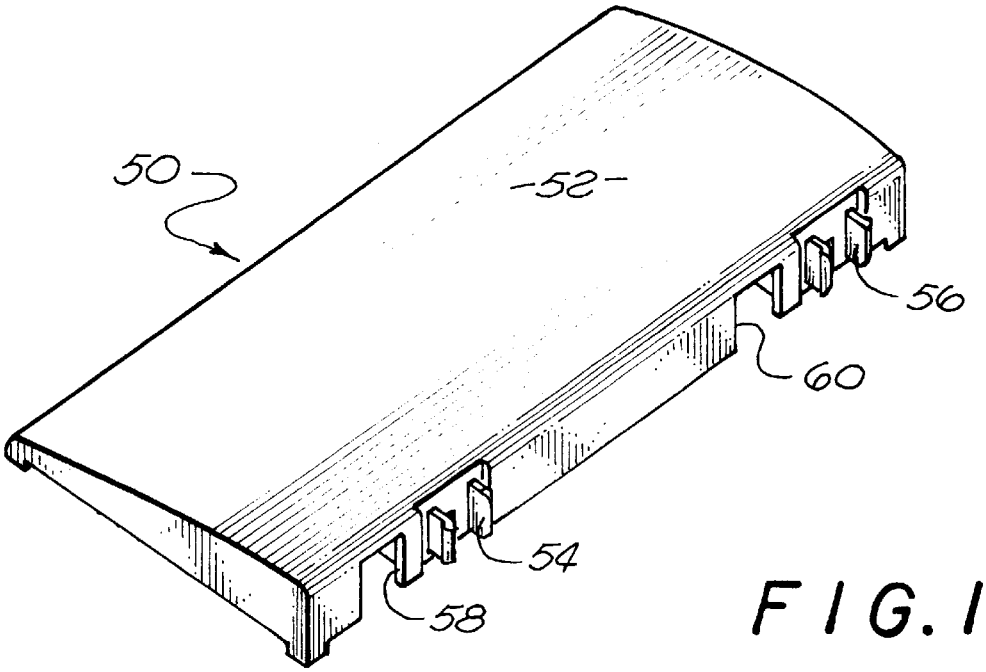
FIG. 10 is a perspective view of a member which incorporates the features of this invention and which has utility as a ramp, an awning or a roof.

FIG. 10 shows a miniramp generally indicated at 50. As will be seen, the miniramp 50 has an inclined surface 52 and has a pair of snaps 54 near one lateral end of the miniramp 50 and has a pair of snaps 56 near the other lateral end of the miniramp. The snaps 54 and 56 correspond in construction to the snaps 30. The snaps in each pair have the same spacing as the snaps 30 on one of the end faces 26 in the beam 22.

An opening 58 corresponding in construction and dimensions to the opening 14 in the block 10 is provided between the snaps 54 and the adjacent lateral extremity of the miniramp 50. In like manner, an opening 60 is provided between the snaps 54 and 56 but adjacent to the snaps 56. Two of the miniramps 50 can be illustratively coupled to each other to form a roof by disposing the snaps 54 in a first one of the miniramps in the opening 60 in the other miniramp and by disposing the snaps 56 in the other miniramp in the opening 58 in the first one of the miniramps.

Figure 12:
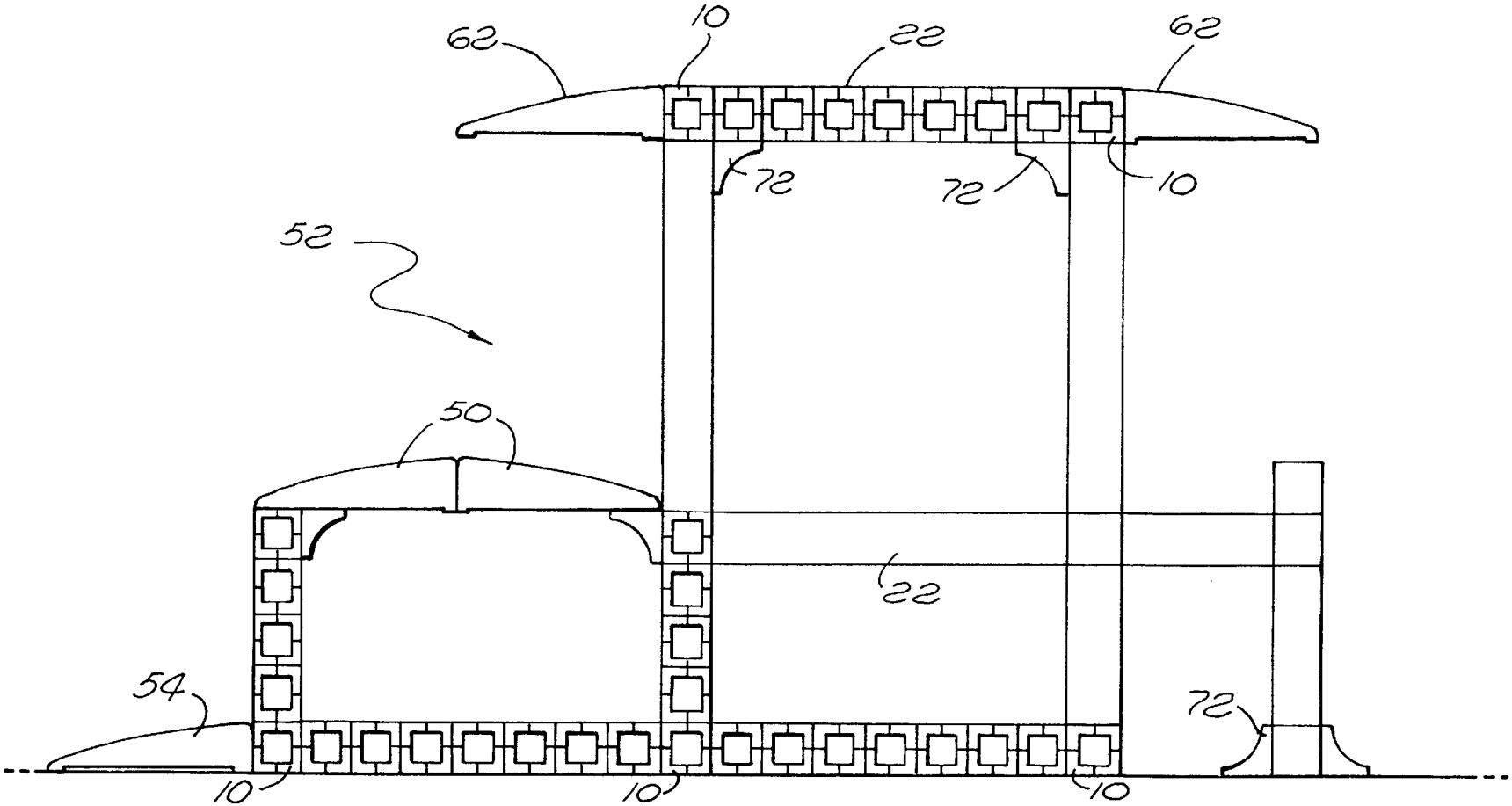
FIG. 12 is a perspective view of a simple structure which can be formed from the blocks, the beams, a pair of the roofs, a ramp and several corbels, all of which are shown in the previous Figures.
Figure 5:
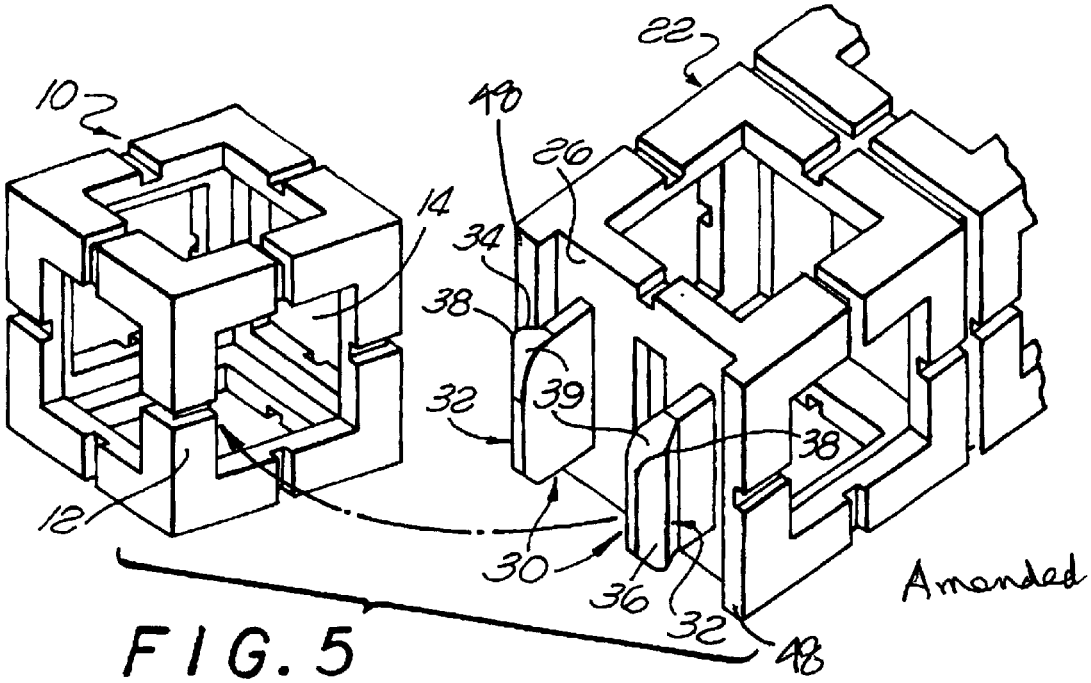
Figure 6:
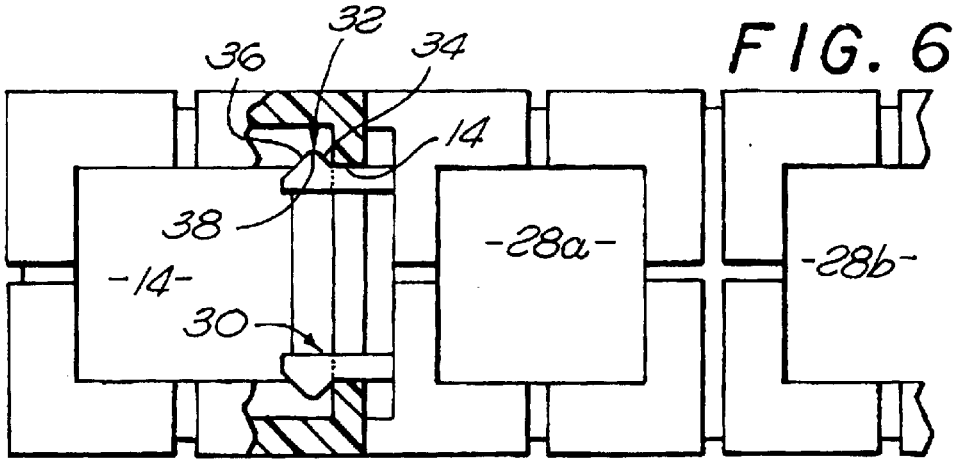
Figure 7:
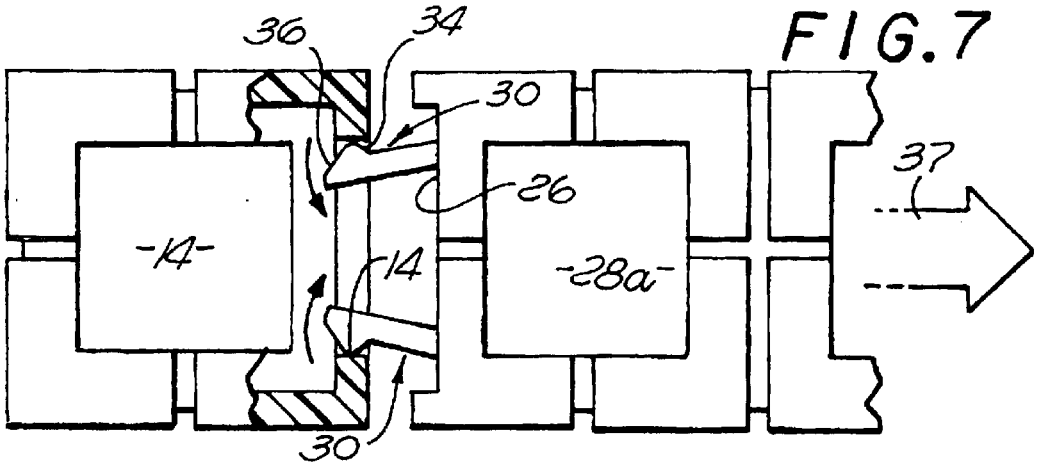
Figure 8:
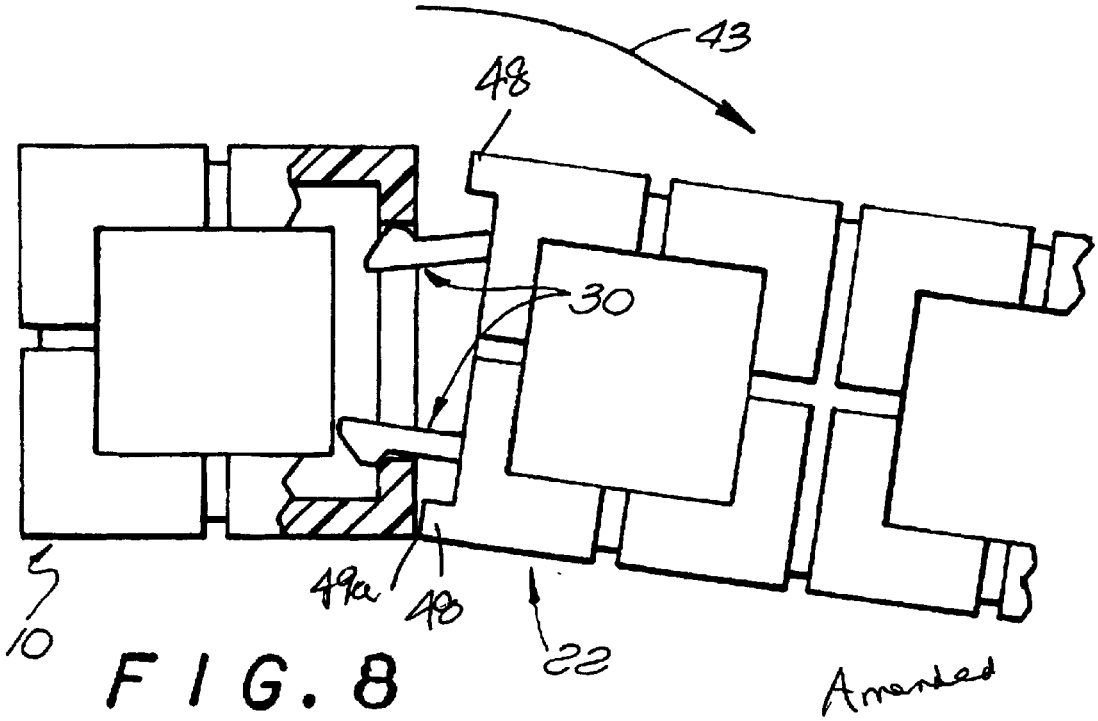
Figure 9:
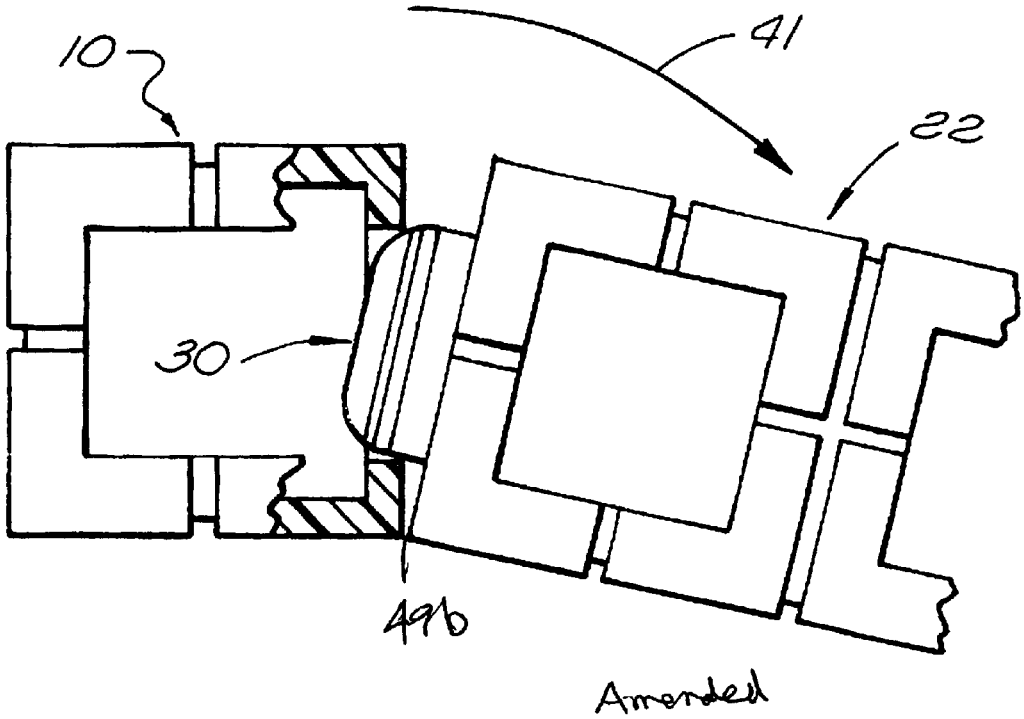

As shown in FIG. 12, the miniramp 50 may be coupled to a structure, generally indicated at 52, formed from a plurality of the blocks 10 and a plurality of the beams 22 so as to define a ramp 70 leading into the structure. When children are engaged in creative play, vehicles may be moved along the ramp 54 by the children into and out of the structure. Alternatively, as shown in FIG. 12, two (2) miniramps 50 may be used as roof overhangs 62 for the structure 52 in addition to the use of an additional one of the miniramps as the ramp 70. The snaps 30 from one of the beams 22 may be inserted into the miniramp 50 when the miniramp is used as the roof overhang 62.

Figure 11:
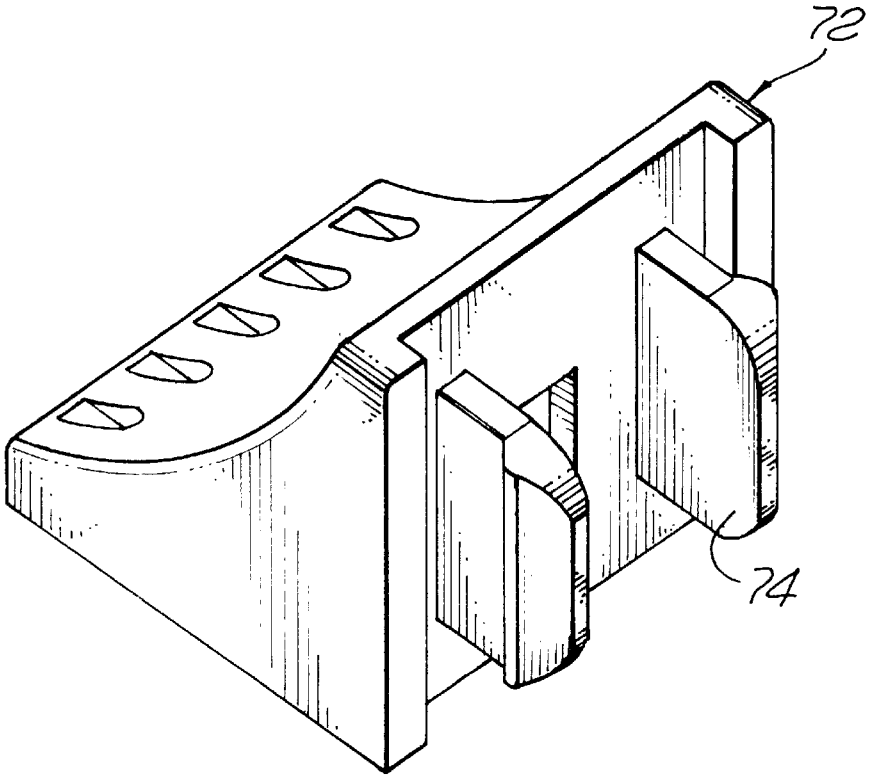
FIG. 11 is a perspective view of another member which incorporates the features of this invention and which constitutes a corbel.

The structure 52 shown in FIG. 12 includes a plurality of corbels. One of the corbels is shown in FIG. 11 and is generally indicated at 72. Each of the corbels 72 is disposed to provide support to the structure 52 in FIG. 12. Each of the corbels 72 includes a pair of snaps 74 having the same construction and disposition relative to each other as the snaps 30 in the beam 22. As will be seen, the snaps 74 are disposed in one of the openings 28 in one of the blocks 10.

The blocks 10 and the beams 22 have certain important advantages when used in a co-operative relationship. The blocks 10 preferably have six (6) identical faces 12 and preferably have identical openings 14 in the different faces. Because of this, all of the faces 12 in the block 10 are female. The beams 22 can be considered as being partially female and partially male. The male members in the beam 22 constitute the snaps 30.

The snaps 30 can be disposed in any of the openings 14 in the blocks 12 without interfering with the snaps in any of the other openings in such blocks. When the snaps 30 from different ones of the beams 22 are in all of the six (6) openings 14 in the block 10, the beams 22 including the snaps extend outwardly from the block 10 in six (6) different directions. This provides for the extension of the structure, such as the structure 52, in six (6) different directions. The snaps 30 in the beams 22 can also be disposed in the openings 28 in others of the beams 22.

When the snaps 30 in one of the beams 22 have been inserted into the opening 14 in the block 10, they can be removed from the openings by pulling (FIG. 7) the snaps out of the openings or by bending (FIGS. 8 and 9) the snaps from the openings in either of two (2) different rotary directions displaced by 90° from each other. This provides for a relatively simple coupling and decoupling of the blocks 10 and the beams 22.

The blocks 10 and the beams 22 have a uniform disposition on a support surface such as a table or a floor. This simplifies the ability of children to form creative structures from the blocks 10 and the beams. It also facilitates the ability to stack the blocks 10 and the beams 22 compactly in an enclosure such as a box when the blocks and the beams are not being used.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

We claim:

1. In combination, a block having a configuration of a rectangular prism defined by six (6) faces and having an opening in at least one of the six (6) faces in the block, a beam having a configuration of a rectangular prism defined by six (6) faces, and snaps extending from two (2) opposite faces in the beam, the snaps from one of the two opposite faces in the beam extending into the opening in the at least one of the faces in the block to provide a coupling between the block and the beam.

2. In a combination as set forth in claim 1, that at least one of the faces in the block constituting a first face, a second one of the faces in the block having an opening corresponding to the opening in the first face in the block, the openings in the first and second faces in the block communicating with each other, the beam constituting a first beam, a second beam having a configuration of a rectangular prism defined by six (6) faces and having snaps extending from two (2) opposite faces in the second beam and having a construction corresponding to that of the first beam, the snaps from one of the two (2) opposite faces in the second beam extending into opening in the second one of the six (6) faces in the block to provide a coupling between the block and the first and second beams without any contact between the snaps in the openings in the first and second faces in the block.

3. In a combination as set forth in claim 1, the openings in the first and second faces in the block being substantially identical.

4. In a combination as set forth in claim 3, there being a pair of snaps extending in a spaced and parallel relationship to each other from each of the two (2) opposite faces of the beam.

5. In a combination as set forth in claim 1 wherein all of the faces in the block have openings and wherein the openings in the faces of the block and in the one of the faces in the beam are substantially identical.

6. In a combination as set forth in claim 5 wherein the snaps extending from the two (2) opposite faces of the beam are substantially identical.

7. In a combination as set forth in claim 6, the beam constituting a first beam, a second beam having a configuration of a rectangular prism defined by six (6) faces and having an opening in at least one of the six (6) faces in the second beam, the snaps from the one of the faces in the first beam extending into the opening in the one of the faces in the block and the snaps from the one of the faces in the second beam extending into the opening in another one of the six (6) faces in the block to provide a coupling between the first and second beams through the block without any interference between the snaps in the beams, the openings in the faces in the block communicating with one another.

8. In a combination as set forth in claim 1 wherein openings are provided in each of the six (6) faces of the block and devoid in each of the four (4) faces in the beam of the snaps and wherein the four (4) faces in the beam define a rectangle in section.

9. In a combination as set forth in claim 1 wherein the beam constitutes a first beam and wherein each of the faces without snaps in the first beam has a plurality of openings at progressive positions along such face and wherein the faces with the openings in the first beam define a rectangle in section and wherein each of the openings in the faces in the block is constructed to receive snaps from beams corresponding to the first beam.

10. In a combination as set forth in claim 1 wherein each face in the block is a square with a dimension of approximately twenty millimeters (20 mm) on each side and wherein each of the openings in the block is a square with a dimension of approximately twelve millimeters (12 mm) on each side.

11. In a combination as set forth in claim 10 wherein each of the faces with snaps in the beam is a square with dimensions of approximately twenty millimeters (20 mm) on each side and wherein at least one of the faces in the beam has an opening defining a square with openings of approximately twelve millimeters (12 mm) on each side.

12. In a combination as set forth in claim 11, a second beam having a configuration of a rectangular prism defined by six (6) faces and having an opening in at least one of the six (6) faces in the second beam, the snaps from the other one of the two faces in the second beam extending into a second one of the six (6) faces having openings in the block to provide a coupling between the first and second beams through the block, the snaps extending from the two (2) faces of the second beam being at opposite ends of the second beam, the openings in the six (6) faces of the block and in the four (4) faces of the first beam being substantially identical, the snaps extending from the two (2) opposite faces of each of the first and second beams being substantially identical, each of the openings provided in each of the six (6) faces of the block and in each of the four (4) faces in each of the first and second beams defining a rectangle in section and the six (6) faces in the block being substantially identical.

13. In combination, a block having a configuration of a rectangular prism defined by six (6) substantially identical faces, particular ones of the faces having substantially identical openings defined by walls in such face in bordering relationship to the openings in such face, a beam having a configuration of a rectangular prism defined by four (4) substantially identical faces disposed relative to one another to define a closed loop, at least a particular one of the four (4) faces having an opening defined by walls in such face in bordering relationship to the opening in such face, and snaps extending from the other two (2) faces of the beam, the snaps extending from each of the two (2) faces of the beam being disposed relative to the walls defining the opening in an individual one of the particular faces of the block to provide a pressed fit relationship with such walls during the insertion of such snaps into the opening in the block.

14. In a combination as set forth in claim 13, the snaps extending from each of the other two (2) faces in the beam being disposed in spaced and parallel relationship to each other and being constructed to extend into the opening in the individual one of the particular faces of the block and to be retained within such opening and to be removed from such opening when a force is applied to obtain such removal.

15. In a combination as set forth in claim 13, the block having openings in each of its six (6) faces, the openings communicating with one another, the snaps extending from one of the other two (2) faces in the beam into the opening in the individual one of the particular faces in the block having dimensions to provide for the insertion of corresponding snaps from other beams into the openings in the other faces in the block without any interference between the snaps in the openings in the block.

16. In a combination as set forth in claim 14, the block being hollow and having openings in the six (6) faces to define, for each of the six (6) faces in the block, inner and outer surfaces defining a particular thickness for such face, each of the snaps in the beam having a portion disposed and shaped to provide a detent with the inner surface of the opening in such face when the snaps are inserted into the opening in such face.

17. In a combination as set forth in claim 16, the portion providing the detent in each of the snaps having a bulbous shape to retain the snap within the opening in such face in the block.

18. In a combination as set forth in claim 17, the detent portion in each snap being shaped to facilitate the insertion of the snap into the opening in such face of the block, the retention of the snap in the opening in the face of the block and the withdrawal of the snap from the opening in the face of the block.

19. In a combination as set forth in claim 18, the snaps extending from each of the other two (2) faces in the beam being disposed in spaced and parallel relationship to each other and being substantially identical, the other two (2) faces in the beam being oppositely disposed in the beam.

20. In a combination as set forth in claim 18, the faces in the block being square and being provided with a dimension of approximately twenty millimeters on each side and the openings in the faces in the block being square and being provided with a dimension of approximately twelve millimeters (12 mm) on each side.

21. In combination, a hollow block having a configuration of a rectangular prism and having six (6) walls each defining a face of the rectangular prism and each having a particular thickness and at least two particular ones of the walls having openings in such walls, a plurality of hollow beams each having a configuration of a rectangular prism and each having six (6) walls, each wall defining a face of such rectangular prism and each wall having a particular thickness, two (2) walls in each of the hollow beams having snaps constructed and shaped to extend into the openings in at least the particular ones of the walls in the block for retention by the walls defining such opening, the snaps in each of the beams being shaped and constructed and being disposed relative to the snaps in the other ones of the beams, with the snaps in the beams being disposed in the openings in the particular ones of the faces of the block, so that none of the snaps in the beams interferes with any of the other snaps in the beams when the snaps are disposed in the openings in the particular ones of the faces in the block, the openings in the particular ones of the faces in the block communicating with one another.

22. In a combination as set forth in claim 21, the four (4) walls in each of the beams without the snaps defining a closed loop and the two (2) walls with the snaps in each of the beams being disposed opposite each other.

23. In a combination as set forth in claim 21, the snaps in each of the two (2) walls in each of the beams having the same construction, the four (4) walls without the snaps in each of the beams having openings and the six (6) walls in the block having openings, the openings in the walls of the beams communicating with one another and the openings in the walls of the block communicating with one another, the openings in the six (6) walls in the blocks and the openings in the four (4) walls in each of the beams being substantially identical.

24. In a combination as set forth in claim 23, each of the walls in the block being defined by external and internal surfaces, each of the snaps in each of the beams having a detent shaped to facilitate the insertion of such detent into any one of the openings in the block, past the internal surface in the wall having such opening, to retain such snap in such opening with the detent on the snap disposed internally of the internal surface of the wall having such opening and to facilitate the removal of such snap from such opening.

25. In a combination as set forth in claim 24, the detent in each snap having a first detent portion shaped to facilitate the insertion of the snap into the opening in the wall in the block past the internal surface in the wall and the retention of the snap in the opening in the wall in the block and having a second detent portion shaped to facilitate the withdrawal of the snap from the opening in the wall of the block, the snaps extending from each of the two (2) faces in each of the beams being disposed in spaced and substantially parallel relationship to each other and being substantially identical, the two (2) walls having the snaps in each of the beams being oppositely disposed in the beam.

26. In combination in a beam for use with a hollow block having a plurality of faces and having an opening in at least one of the faces, the face with the opening having inner and outer surfaces defining a particular thickness for such face, a hollow rectangular prism having four (4) faces defining a rectangle in section and having two (2) opposite faces, there being an opening in at least one of the four (4) faces in the prism, and snaps extending from the two (2) opposite faces in the beam, each of the snaps having first and second detent portions, the first detent portion in each of the snaps being shaped to facilitate the insertion of the detent portion into the opening in the at least one of the faces of the block for disposition of the detent portion within the inner surface of the face and having a second detent portion shaped to facilitate the removal of the detent from the opening in the at least one of the faces of the block.

27. In a combination as set forth in claim 26, the first and second detent portions in each snap having a common boundary and being defined by progressive variations in the thickness of such detent portions at progressive positions along the detent portions from the common boundary.

28. In a combination as set forth in claim 26, the detent portions in each snap defining a detent, the detent having lateral extremities, the detent in each snap being rounded at the lateral extremities of the detent to facilitate the removal of the snap from the opening in the face of the block by a bending movement of the beam.

29. In a combination as set forth in claim 26, each of the faces of the beam defining a square with a dimension of approximately twenty millimeters (20 mm) on each side and each of the openings in each face in the beam block defining a square with a dimension of approximately twelve millimeters (12 mm) on each side.

30. In a combination as set forth in claim 26, the first detent portion of each snap having a progressively increasing thickness with progressive distances from the face from which the snap extends, the second detent portion of each snap having a progressively decreasing thickness with progressive distances from the face from which the snap extends, the first and second detent portions of each snap having a common boundary at their positions of substantially greatest thickness.

31. In a combination as set forth in claim 30, each face in the beam constituting a square with a distance of approximately twenty millimeters (20 mm) on each side of such square and each opening in each face constituting a square with a distance of approximately twelve millimeters (12 mm) on each side of such square.

32. In a combination as set forth in claim 31, each of the snaps having rounded corners at the positions of the detent portions in such snap to facilitate the removal of the snaps from the openings in the faces of the blocks by bending the snaps progressively from the openings.

33. In a combination as set forth in claim 32, there being identical openings in the four (4) faces of the beam, the two (2) opposite faces of the beam having no openings, the snaps in the two opposite faces of the beam being substantially identical, there being in each of the two (2) opposite faces of the beam two (2) snaps in spaced and substantially parallel relationship to each other.

34. In combination, a hollow block having a plurality of faces defining a rectangular prism, each of the faces having inner and outer surfaces defining a particular thickness and at least one of the faces having an opening, a beam having a plurality of faces defining a hollow rectangular prism, four (4) of the faces defining a rectangle in section and the other two (2) faces being opposite each other and being substantially parallel to the rectangle defined in section by the four (4) faces, there being an opening in at least one of the four (4) faces defining the rectangle in section in the beam, and snaps extending from the other two (2) faces of the beam, each of the snaps having first and second detent portions, the first detent portion in each of the snaps being shaped to facilitate the insertion of the detent portions of the snaps into the opening in the at least one of the faces of the block and the disposition of the detent portion within the inner surface of the face and having a second detent portion shaped to facilitate the removal of the snaps from the opening in at least one of the faces of the block, the first and second detent portions in each snap being contiguous to each other.

35. In a combination as set forth in claim 34, the first and second detent portions in each snap having a common boundary with a maximum thickness and the first detent portion having a progressively decreasing thickness with progressive positions away from the beam from which the snap extends and the second detent portion having a progressively decreasing thickness with progressive positions toward the beam from which the snap extends.

36. In a combination as set forth in claim 35 wherein each of the snaps is rounded at the positions of the detent portions in a direction substantially perpendicular to the directions of the progressive variations in the thicknesses of the detent portions to facilitate the removal of the snaps from the openings in the faces of the blocks by bending the snaps progressively from the openings.

37. In a combination as set forth in claim 34 wherein the block is a cube and wherein an opening is provided in each of the faces of the block and wherein the openings in the faces of the block are substantially identical.

38. In a combination as set forth in claim 37 wherein there is at least one opening in each of the four (4) faces of the beam and each of these openings is substantially identical to the openings in the faces of the block.

39. In a combination as set forth in claim 37 wherein the other two faces of the beam have no openings and wherein the snaps in the other two (2) faces of the beam are identical and there are two (2) snaps in each of the other two (2) faces of the beam and the two (2) snaps in each of the other two (2) faces are in spaced and parallel relationship to each other.

40. In a combination as set forth in claim 38, each face in the block and in the beam constitutes a square with a distance of approximately twenty millimeters (20 mm) on each side of the square and wherein each opening in the block and in the beam constitutes a square with a distance of approximately twelve millimeters (12 mm) on each side of the square.

41. In combination for use with a first member having at least one face and having an opening in the face, the face having first and second surfaces defining a particular thickness for such face, a second member, and snaps extending from the second member, each of the snaps having first and second detent portions, the first detent portion in each of the snaps being shaped to facilitate the insertion of the detent portions of the snaps into the opening in the face of the first member for disposition of the detent portions at the second surface in the face of the first member and having a second portion shaped to facilitate the removal of the snaps from the opening in the face of the first member.

42. In a combination as set forth in claim 41, the first and second detent portions in each snap having a common boundary and being defined by progressive variations in the thickness of such detent portions from the common boundary.

43. In a combination as set forth in claim 41, the detent portions in each snap defining a detent having lateral extremities, the first and second detent portions in each snap being rounded at the lateral extremities of such snap to facilitate the removal of the snap from the opening in the first member by a bending movement of the second member.

44. In a combination as set forth in claim 26, the lateral dimension of each snap being approximately twelve millimeters (12 mm).

45. In a combination as set forth in claim 42, the detent portions in each snap defining a detent having lateral extremities, the first and second detent portions in each snap being rounded at the lateral extremities of such snap to facilitate the removal of the snap from the opening in the first member by a bending movement of the second member, the lateral dimension of each snap being approximately twenty millimeters (20 mm).

46. In combination for use with a first member having at least one face and having an opening defined by a wall in the face, the wall having inner and outer surfaces defining a particular thickness for the wall, a second member, and snaps extending from the second member, each of the snaps having a detent constructed to be inserted into the opening in the first member from the outer surface of the opening in the wall of the first member for disposition against the inner surface of the wall and to be removed from the wall in the first member either by the insertion of a force on the second member in a direction substantially perpendicular to the wall of the first member or by bending the snap from the opening in the wall of the first member.

47. In a combination as set forth in claim 46, the bending of each snap from the opening on the face of the first member being in a first direction, the detent on each of the snaps on the second member being constructed to be removed from the member by bending the snap from the opening in the face on the first member in a second direction substantially perpendicular to the first direction.

48. In a combination as set forth in claim 46, each detent having a first portion with a progressively increasing thickness and having a second portion extending from the first portion with a progressively decreasing thickness to facilitate the insertion of the detent into the opening in the first member from the outer surface of the face of the first member through the opening in the face of the first member and to facilitate the removal of the detent from the first member by the exertion of a force on the snap in the direction substantially perpendicular to the face of the first member.

49. In a combination as set forth in claim 46, the detent having rounded corners to facilitate the removal of the detent from the opening in the face of the first member by bending the snap from the opening in the face of the first member.

50. In a combination as set forth in claim 47, each detent having a first portion with a progressively increasing thickness and having a second portion extending from the first portion with a progressively decreasing thickness to facilitate the insertion of the detent into the opening in the first member from the outer surface of the face of the first member through the opening in the face of the first member and to facilitate the removal of the detent from the first member by the exertion of a force on the snap in the direction substantially perpendicular to the face of the first member, the detent having rounded corners to facilitate the removal of the detent from the opening in the face of the first member by bending the snap from the opening in the face of the first member.

51. In a combination as set forth in claim 46, the second member having a wall with an opening constructed as specified for the opening specified for the opening in the wall in the first member to receive snaps in a third member with the same construction as the snaps in the second member.

52. In a combination as set forth in claim 50, the second member having a wall with an opening constructed as specified for the opening as specified for the opening in the wall in the first member to receive snaps in a third member with the same construction as the snaps in the second member.

53. In combination for use with a first member having a wall and having an opening in the wall with the wall having inner and outer surfaces defining a particular thickness of the wall, a second member, and snaps extending from the second member, each of the snaps having a detent constructed to be inserted into the opening in the wall of the first member from the outer surface of the wall through the opening in the wall for disposition against the inner surface of the wall and to be removed from the wall in the first member by bending the snap from the opening in the wall in either of two (2) substantially perpendicular directions.

54. In a combination as set forth in claim 53, each detent having a first portion with a progressively increasing thickness and a second portion extending from the first portion with a progressively decreasing thickness to facilitate the insertion of the detent into the opening in the wall of the first member through the opening in the wall and to facilitate the removal of the detent from the first member by bending the snap in one of two (2) substantially perpendicular directions.

55. In a combination as set forth in claim 53 wherein the detent has rounded corners to facilitate the removal of the detent from the opening in the wall in the first member by bending the snap in one of the two (2) substantially perpendicular directions.

56. In a combination as set forth in claim 53 wherein the second member has a wall with an opening constructed as specified for the opening in the wall in the first member to receive snaps in a third member with the same construction as the snaps in the second member.

57. In a combination as set forth in claim 54 wherein the detent has rounded comers to facilitate the removal of the detent from the first member by bending the snap in the other of the two (2) substantially perpendicular directions and wherein the second member has a wall with an opening constructed as specified for the opening in the first member to receive snaps in a third member with the same construction as the snaps in the second member.

58. In a combination as set forth in claim 12, the openings in each of the six (6) faces in the block and in each of the four (4) faces in each of the first and second beams being substantially identical.

59. In a combination as set forth in claim 26, the detent portions in each snap being shaped to provide for a removal of the snap from the opening in at least one of the faces of the block by a bending movement of the beam.

60. In a combination as set forth in claim 26, the detent portions in each snap being shaped to provide for a removal of the snap from the opening in at least one of the faces of the block by a bending movement of the beam in either of two (2) substantially perpendicular directions.

61. In a combination as set forth in claim 26, the detent portions in each snap being shaped to provide for a removal of the snap from the opening in at least one of the faces of the block by a movement of the beam in a direction substantially perpendicular to at least one of the faces of the block.

62. In a combination as set forth in claim 41, the first and second detent portions in each snap being shaped to provide for a removal of the snap from the opening in the face of the first member by a movement of the second member in a direction substantially perpendicular to the face of the first member or by a bending movement of the second member.

63. In a combination as set forth in claim 41, the first and second detent portions in each snap being shaped to provide fora removal of the snap from the opening in the face of the first member by a bending movement of the second member in either of two (2) substantially perpendicular directions.

* * * * *

US005826394C1

(12) EX PARTE REEXAMINATION CERTIFICATE (5400th)

United States Patent
Barton, Jr. et al.

(10) Number: US 5,826,394 C1
(45) Certificate Issued: Jun. 13, 2006

(54) BASIC BUILDING BLOCKS FOR CONSTRUCTING COMPLEX BUILDING STRUCTURE

(75) Inventors: William M. Barton, Jr., Encinitas, CA (US); Lonnie Pogue, San Diego, CA (US)

(73) Assignee: Imperial Bank, San Diego, CA (US)

Reexamination Request:
No. 90/005,675, Mar. 13, 2000

Reexamination Certificate for:

| | |
|---|---|
| Patent No.: | **5,826,394** |
| Issued: | **Oct. 27, 1998** |
| Appl. No.: | **08/752,213** |
| Filed: | **Nov. 19, 1996** |

(51) Int. Cl.

| | |
|---|---|
| ***E04B 2/08*** | (2006.01) |
| ***E04B 2/18*** | (2006.01) |
| ***E04B 2/32*** | (2006.01) |
| ***E04B 2/46*** | (2006.01) |

(52) U.S. Cl. ..... 52/592.1; 52/503; 52/504; 52/505; 446/100; 446/116; 446/128; 446/188; 446/85; 446/98

(58) Field of Classification Search ..... None
See application file for complete search history.

(56) References Cited

U.S. PATENT DOCUMENTS

| | | | | | |
|---|---|---|---|---|---|
| 1,473,796 | A | * | 11/1923 | Newman | |
| 2,487,654 | A | * | 11/1949 | Hoffman et al. | |
| 3,195,266 | A | | 7/1965 | Onanian | |
| 3,205,611 | A | * | 9/1965 | Onanian | 446/89 |
| 3,367,063 | A | * | 2/1968 | Bondesen et al. | |
| 3,374,917 | A | | 3/1968 | Troy | |
| 3,415,007 | A | * | 12/1968 | Howe | 446/124 |
| 3,545,122 | A | * | 12/1970 | Onanian | 446/125 |
| 3,651,597 | A | * | 3/1972 | Daenen | 446/124 |
| 3,993,313 | A | * | 11/1976 | Tillotson | 273/282.1 |
| 4,003,144 | A | * | 1/1977 | Maddestra et al. | |
| 4,012,155 | A | * | 3/1977 | Morris | |
| 4,143,481 | A | * | 3/1979 | Loechel | 446/122 |
| 4,430,826 | A | * | 2/1984 | Ryaa | 446/124 |
| 4,551,110 | A | * | 11/1985 | Selvage et al. | 446/118 |
| 4,602,908 | A | * | 7/1986 | Kroeber | 446/128 |
| 4,676,762 | A | * | 6/1987 | Ballard | 446/104 |
| 4,833,856 | A | * | 5/1989 | Zwagerman | 52/592.1 |
| 4,895,544 | A | * | 1/1990 | Fischer | 446/122 |
| 4,964,833 | A | * | 10/1990 | Suzuki | 446/118 |
| 5,000,713 | A | * | 3/1991 | Cheng | |
| 5,013,245 | A | * | 5/1991 | Benedict | 434/170 |
| 5,022,885 | A | * | 6/1991 | Lyman | 446/95 |
| 5,098,328 | A | * | 3/1992 | Beerens | 446/128 |
| 5,259,803 | A | * | 11/1993 | Lyman | 446/103 |
| 5,306,198 | A | * | 4/1994 | Forman | 446/120 |
| 5,322,467 | A | * | 6/1994 | Barzani | 446/125 |
| 5,350,331 | A | * | 9/1994 | Glickman | 446/126 |
| 5,378,185 | A | * | 1/1995 | Ban | 446/124 |
| 5,458,522 | A | * | 10/1995 | Brooks, III | 446/85 |
| 5,683,283 | A | * | 11/1997 | Glynn | 446/128 |

* cited by examiner

*Primary Examiner*—Robert Canfield

(57) ABSTRACT

A hollow block (e.g. a rectangular prism) preferably has six (6) perpendicular faces. Each face preferably has a wall with a particular thickness. An opening is provided in at least a particular one of the faces, and preferably in all six (6) faces. A hollow beam (e.g. a rectangular prism) preferably has six (6) perpendicular faces. Each face is preferably defined by a wall with a particular thickness. An opening is provided in at least a particular one of the faces, and preferably in the four (4) faces defining a closed loop, in the beam. Substantially parallel snaps extend from the other two (2) beam walls and have at their outer ends portions shaped to facilitate insertion of such snaps into the opening in the particular face of the block, retention of the snaps by the inner surface of the face defining the opening and removal of the snaps from the opening. Such portions are shaped for the beams to be pulled, peeled or bent from the block. When the block has an opening in each of its six (6) faces, snaps from six (6) different beams can extend into the six (6) different openings in six (6) different directions in the block without any interference in the block from the snaps in the six (6) beams. In this way, complex structures can be formed from the blocks and the beams. Other structures such as vehicle ramps, building roofs, awnings and corbels can be disposed in a cooperative relationship with a structure formed from the blocks and the beams.

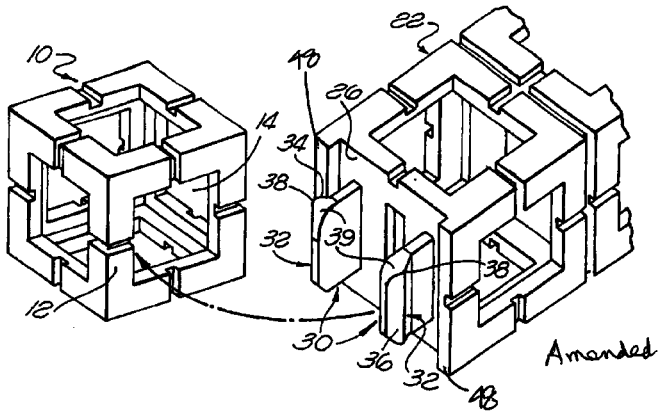

FIG. 3
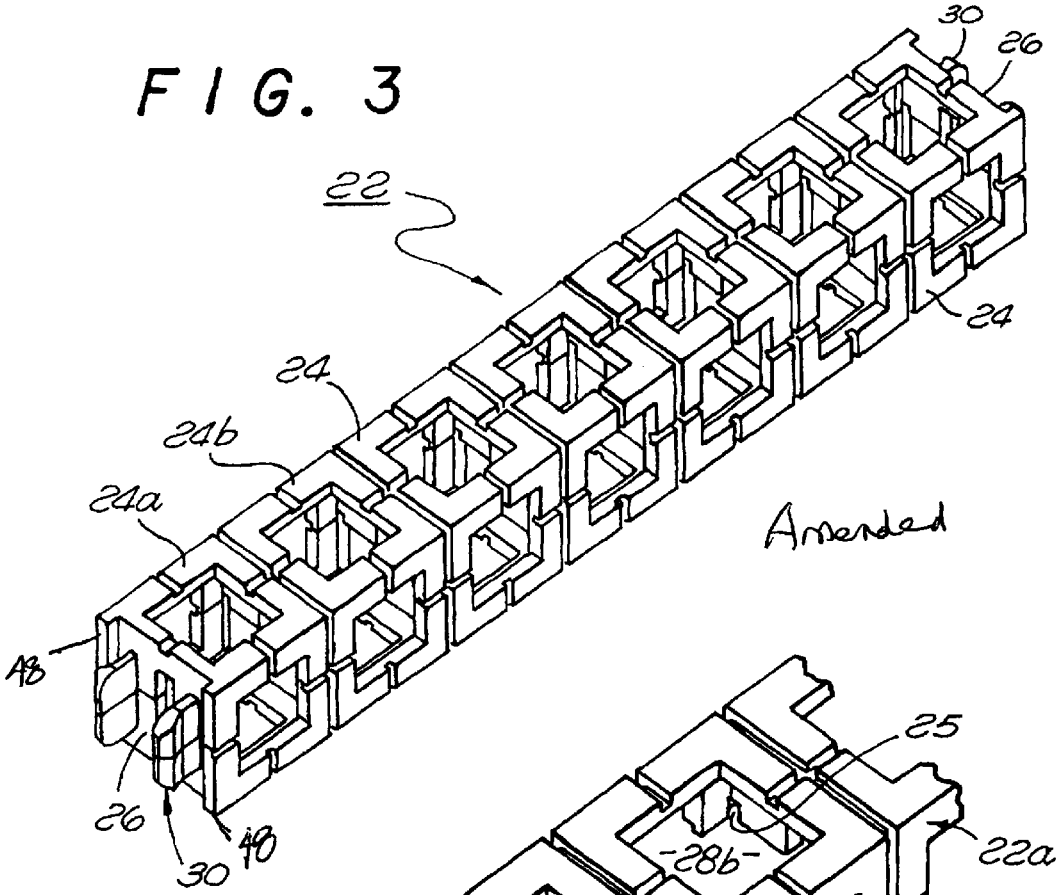
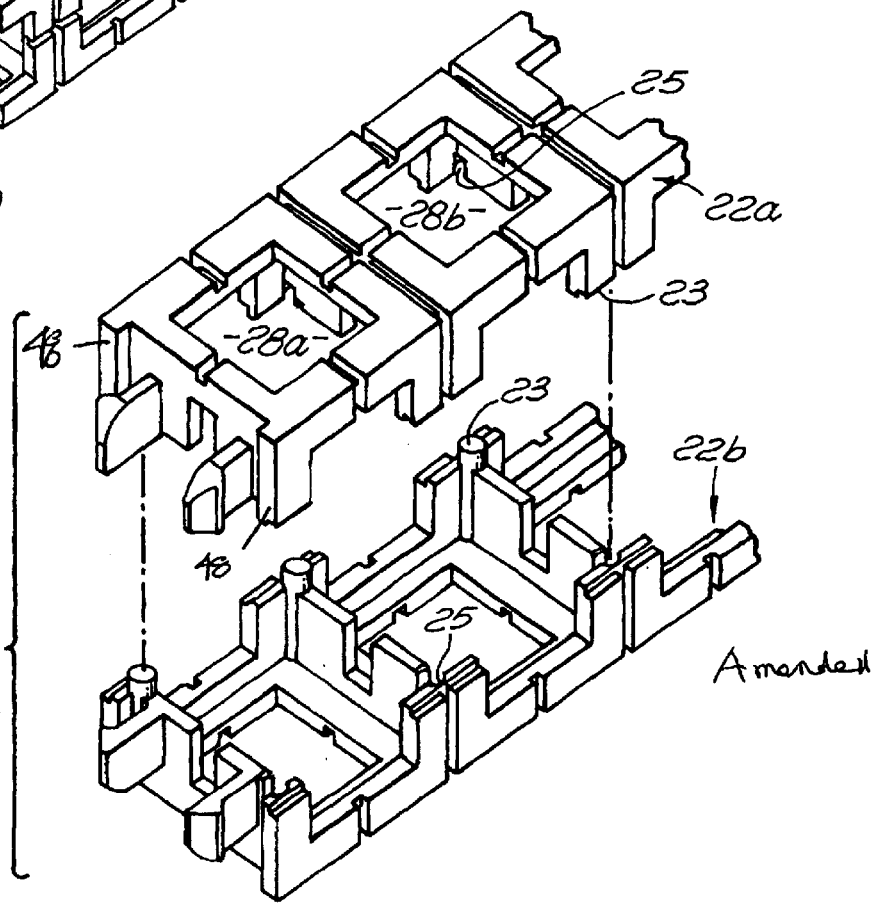
FIG. 4

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 12–23:

In one embodiment of the invention, a hollow block generally indicated at 10 (FIGS. 1 and 2) is provided. The block 10 may be made from a suitable *rigid* thermoplastic material such as an acrylonitrile-butadiene-styrene (ABS). The block may preferably be in the form of a rectangular prism with six (6) substantially identical faces 12. Each of the faces 12 may have a configuration of a square with a suitable length such as approximately twenty millimeters (20 mm) for each side of the square, a thickness of approximately two millimeters (2 mm) and a centrally disposed square opening 14 of approximately twelve millimeters (12 mm) for each side of the opening.

Column 3, lines 24–32:

Openings 14 are preferably provided in each of the faces 12. It will be appreciated, however, that the opening 14 may be provided in any number of the faces from one (1) to six (6). *Each of the openings 14 has substantially parallel side surfaces and substantially parallel top and bottom surfaces.* A number of the blocks 10 may be provided with the openings 14 in only a limited number of the faces 12. Of course, limiting the number of the faces 12 with the openings 14 in the blocks 10 limits the utility which can be provided for the blocks. Grooves 16 may be provided in the faces 12 for decorative purposes. *The openings 14 in the different faces 12 of the block 10 communicate with one another.*

Column 3, between lines 48 and 49:

*The snaps 30 are planar and extend in a direction substantially perpendicular to the particular one of the faces in the block 10. The snaps 30 are disposed in the direction of the side surfaces defining the opening 14 in a particular one of the block walls through which the snaps extend. The snaps 30 are contiguous to the side surfaces of the opening 14. The snaps 30 are constructed to engage the side surfaces defining the opening 14 in the particular one of the faces in the block 10 during the movement of the snaps into the hollow block through the opening in the particular one of the faces in the block and during the movement of the snaps out of the hollow block through the opening in the particular one of the faces in the block.*

Column 3, lines 49–57:

A beam generally indicated at 22 (FIGS. 3 and 4) is adapted to be used in conjunction with the block 10. The beam 22 may be made from a suitable *rigid* thermoplastic material such as an acrylonitrile-butadiene-styrene (ABS). The beam may preferably be in the form of a rectangular prism with four (4) substantially identical faces 24 defining a rectangle in section and with two substantially identical end faces 26 in opposed relationship at the opposite ends of the faces 24.

Column 4, lines 20–34:

Snaps generally indicated at 30 are preferably provided in the two (2) end faces 26. Preferably two (2) snaps 30 extend *integrally* from each of the end faces 26 *as shown at the lower left end in the section 22b in FIG. 4. The snaps 30 extend only from the external surfaces of the end faces and not from the internal surfaces of the end faces*. The snaps 30 on each of the end faces 26 are substantially identical and are substantially parallel to each other. Each of the snaps 30 has at its outer end a portion which may be considered as a detent 32 (FIGS. 5 and 6). Each detent 32 has a first portion 34 which progressively increases in thickness with progressive distances from the end faces 26. Each of the detents 32 has a second portion 36 which progressively decreases in thickness with progressive distances from the end faces 26. The first detent portion 34 and the second detent portion 36 have a common boundary 38 at the positions of their maximum thicknesses. *The change in the thickness of the detent portions 34 and 36 is in a direction substantially perpendicular to the direction of the side surfaces in the opening 14 of the wall in the hollow block through which the snaps 30 extend.* As will be seen, the detent portions 32 and 34 of each snap 30 have a bulbous shape.

Column 4, lines 35–46:

The snaps 30 are constructed to be inserted into *and through and past* the openings 14 in the block 10. The progressive increase in thickness of the detent portion 36 facilitates this insertion. When the snaps 30 have been inserted into *and through and past* one of the openings 14, the detent portions 34 and 36 are disposed internally of the internal surface of the face 12 defining such opening. The snaps 30 may also be removed easily from the opening 14 in the face 12 by pulling the snaps outwardly from the opening. This is indicated by an arrow 37 in FIG. 7. The progressive increase in the thickness of the detent portions 34 in the snaps 30 facilitates the removal of the snaps from the opening 14.

Column 4, between lines 46 and 47:

*The snaps 30 are planar and substantially identical and extend in a direction substantially perpendicular to the particular one of the faces in the block 10. The snaps 30 are disposed in the direction of the side surfaces defining the opening 14 in a particular one of the block walls through which the snaps extend. The snaps 30 are contiguous to the side surfaces of the opening 14. The snaps 30 are constructed to engage the side surfaces defining the opening 14 in the particular one of the faces in the block 10 during the movement of the snaps into and through and past the opening in the particular one of the faces in the block and during the movement of the snaps through and from the opening in the particular one of the faces in the block.*

Column 4, lines 47–62:

At the positions of the detent portions 34 and 36 in each snap 30, the snap is provided with a rounded surface 39 at the opposite *lateral extremities or* ends of the snap. The rounded surface 39 on each snap 30 provides for the removal of each snap from the opening 14 in the face 12 of the block 10 by bending the snap from the opening. This may be seen from FIG. 9 where the snaps 30 on one of the beams 22 have been partially bent out of the opening 14. The direction of such bending is indicated by an arrow 41 in FIG. 9. As will be appreciated, the detent portions 34 also facilitate the bending action to remove the snaps 30 from the opening 14. This bending is indicated by an arrow 43 in FIG. 8. This bending is in a direction perpendicular to the bending shown in FIG. 9. This may be seen from FIG. 8 which shows the snap 30 partially removed from the opening 14 in the block 10 as a result of the bending of the beam 22 in the direction 43.

Column 4, between lines 62 and 63:

*As will be seen in FIGS. 3, 4, 5 and 8, the beam 22 is provided with flanges 48 which are integral with the faces 24 from which the flanges extend. The flanges 48 extend integrally and outwardly from each of the opposite faces of the beam 22 and are substantially parallel to each other and to the snaps 30 extending from the face. The flanges 48 extending from each of the faces 24 of the beam 22 are spaced from each other and from the snaps 30 which extend from the face. The extension of the flanges 48 from the faces 24 is in a direction substantially perpendicular to the faces. The flanges 48 provide for a spaced relationship between the adjacent face 12 of the block 10 and the beam face 24 from which the flanges extend.*

Figure 8:
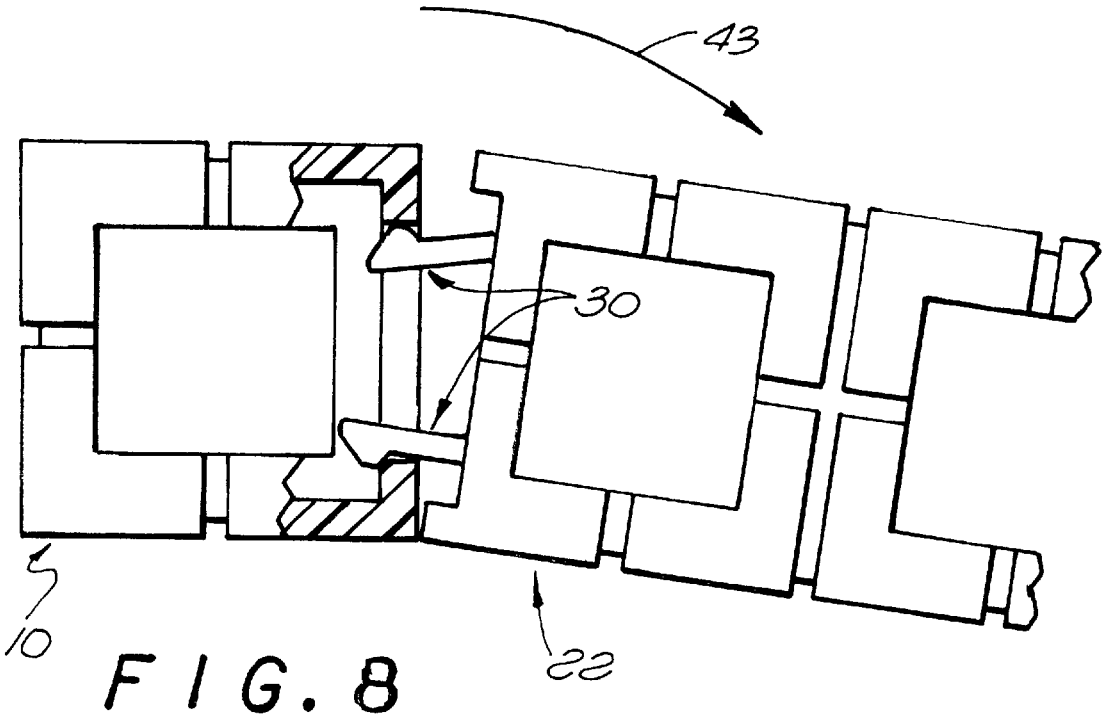
FIG. 8 is a view similar to that shown in FIGS. 6 and 7 and shows the beam partially removed from the block when a bending force indicated by an arrow is imposed on the beam.
Figure 9:
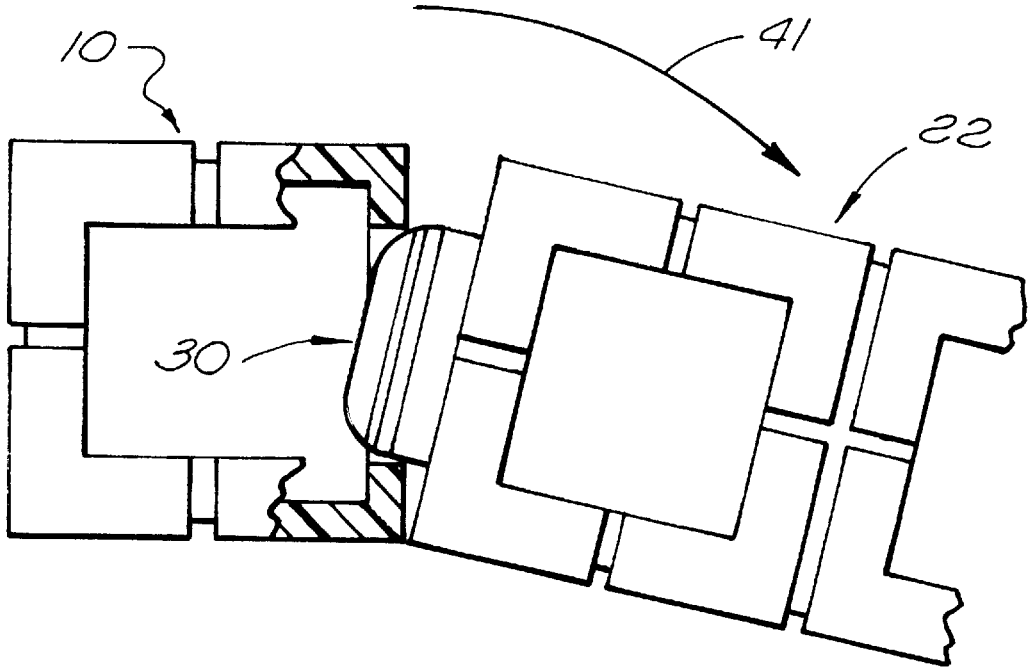
FIG. 9 is a view similar to that shown in FIGS. 6–8 and shows the beam partially removed from the block when a bending force indicated by an arrow is imposed on the beam, this bending force being displaced by an angle of substantially 90° from the bending force shown in FIG. 8.

*As will be seen in FIG. 8, the flanges 48 provide a fulcrum 49a around which the beam 22 pivots when the snaps 30 are bent in a first direction to remove the snaps from a coupled relationship with the block 10. As shown in FIG. 9, the flanges 48 also provide a fulcrum 49b around which the beam 22 pivots when the snaps are bent in a second direction perpendicular to the first direction to removed the snaps from the coupled relationship with the beam.*

*The flanges 48 cause the lengths of the snaps 30 from the face 24 of the beam 22 to the opening 14 in the face 12 of the block 10 to increase. This increases the leverage provided by the snaps 30 when the snaps are bent as in FIGS. 8 and 9 to remove the snaps 30 from the opening 14 in the face 12 of the block 10. It accordingly causes the force required to uncouple the snaps 30 from the opening 14 in the faced 12 of the block 10 to decrease.*

Figure 7:
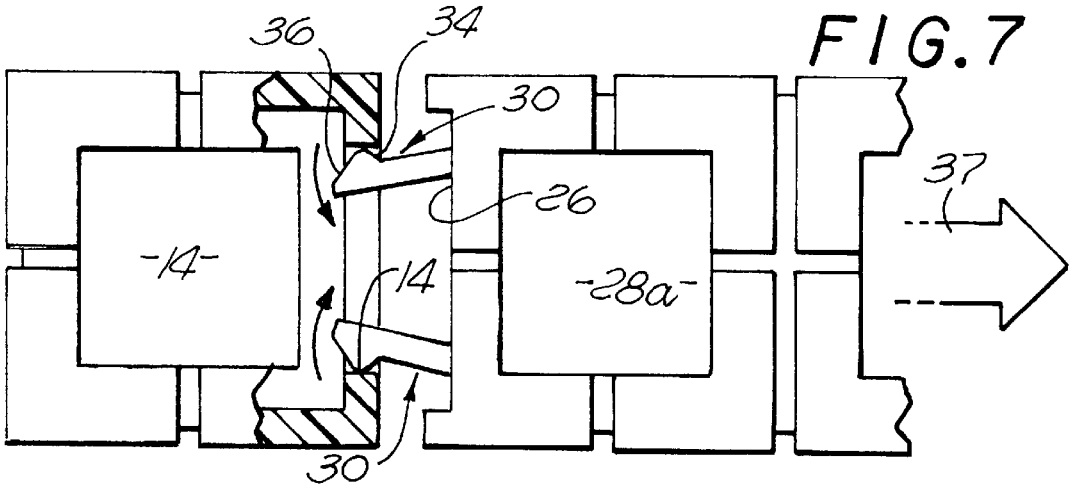
FIG. 7 is a view similar to that shown in FIG. 6 and shows the beam partially removed from the block when a force indicated by an arrow is imposed on the beam in a direction away from the block.

*Although the snaps 30 can be uncoupled from the block 10 in each of the three (3) directions schmetically illustrated in FIGS. 7, 8, and 9, the force required to uncouple the snaps from the block 10 is less for the directions shown in FIGS. 8 and 9 than for the direction shown in FIG. 7. This is particularly true since the snaps 30 experience friction with the opening 14 in the face 12 of the block 10 when the snaps are withdrawn through the opening in the direction shown in FIG. 7. This is particularly important when children in the age group of approximately 6–11 uncouple the blocks 10 and beams 22. As a result, the natural way for a child to withdraw the snaps 30 from the opening 14 in the face of the block 10 is to bend the snaps in one of the directions shown in FIGS. 8 and 9.*

Column 4, line 63 to column 5, line 7:

It should be appreciated that the beam 22 does not have to be coupled to one of the openings 14 in the block 10. The beam 22 can also be coupled to one of the openings 28 in another one of the beams 22. However, the coupling of two (2) beams can occur in only one of four (4) different directions because the snaps 30 are disposed on the beams in the other two (2) directions. However, the coupling of one of the beams 22 and one of the blocks 10 can occur in any of six (6) different directions. It will thus be seen that a coupling of one of the beams 22 to one of the blocks 10 is preferable to a coupling of two (2) beams. *The snaps 30 in two (2) different beams 22 can be respectively coupled to the openings 14 in two (2) different faces 12 in the block 10 without any interference between the snaps 30.*

THE DRAWING FIGURES HAVE BEEN CHANGED AS FOLLOWS:

Reference numeral 48 added to FIGS. 3, 5, and 8. Reference numeral 49a added to FIG. 8. Reference numeral 49b added to FIG. 9.

AS A RESULT OF REEXAMINATION, IT HAS BEEN DETERMINED THAT:

The patentability of claims 5, 10, 11, 23, 27, 29, 35–40, 42, 48, 50 and 54 is confirmed.

Claims 1–4, 21, 22, 26, 28, 34, 41, 43–47, 49, 51–53, 55–57 and 59–63 are cancelled.

Claims 6–9, 12–15, 17, 18, 24, 25, 30 and 32 are determined to be patentable as amended.

Claims 16, 19, 20, 31, 33 and 58, dependent on an amended claim, are determined to be patentable.

6. In a combination as set forth in claim 5 wherein the snaps extending from the two (2) opposite faces of the beam are *planar and* substantially identical.

7. In a combination as set forth in claim 6,

*the block, the beam and the snaps being made from a rigid material,* the beam constituting a first beam, a second beam *made from a rigid material and* having a configuration of a rectangular prism defined by six (6) faces and having an opening in at least one of the six (6) faces in the second beam, the snaps from the one of the faces in the first beam extending into *and through and past* the opening in the one of the faces in the block and the snaps from the one of the faces in the second beam extending into *and through and past* the opening in another one of the six (6) faces in the block to provide a coupling between the first and second beams through the block without any interference between the snaps in the beams, the openings in the faces in the block communicating with one another.

8. In a combination as set forth in claim 1 wherein openings are provided in each of the six (6) faces of the block and [devoid] in each of the four (4) faces *devoid* in the beam of the snaps and wherein the four (4) faces in the beam define a rectangle in section.

9. In a combination as set forth in claim 1 wherein the beam constitutes a first beam and wherein each of the faces without snaps in the first beam has a plurality of openings at progressive positions along such face and wherein the faces with the openings in the first beam define a rectangle in section and wherein each of the openings in the faces in the block is constructed to receive [snaps from] *and pass snaps on* beams corresponding to the first beam.

12. In a combination as set forth in claim 11,

*the block and the beam and the snaps being made from a rigid material,* a second beam *made from a rigid material and* having a configuration of a rectangular prism defined by six (6) faces and having an opening in at least one of the six (6) faces in the second beam,

[the] snaps from [the other] one of the two faces in the second beam extending into *and through and past* a second one of the six (6) faces having openings in the block to provide a coupling between the first and second beams through the block, the snaps extending from the two (2) faces of the second beam being at opposite ends of the second beam, the openings in the six (6) faces of the block and in the four (4) faces of the first beam being substantially identical, the snaps extending from the two (2) opposite faces of each of the first and second beams being substantially identical, each of the openings provided in each of the six (6) faces of the block and in each of the four (4) faces in each of the first and second beams defining a rectangle in section and the six (6) faces in the block being substantially identical.

13. In combination, a block having a configuration of a rectangular prism defined by six (6) substantially identical faces, particular ones of the faces having substantially identical openings defined by walls in such faces in bordering relationship to the openings in such face*s*, a beam having a configuration of a rectangular prism defined by four (4) substantially identical faces disposed relative to one another to define a closed loop, at least a particular one of the four (4) faces having an opening defined by walls in such face in bordering relationship to the opening in such face, and snaps extending from the other two (2) faces of the beam, the snaps extending from each of the two (2) faces of the beam being disposed relative to the walls defining the opening in an individual one of the particular faces of the block to provide a pressed fit relationship with such walls during the insertion of such snaps into *and through and past* the opening in the block*, and*

*flanges extending from the other two (2) faces of the beam in spaced relationship to the snaps to provide a separation betwen the beam face holding the snaps and the individual one of the particular faces of the block, thereby to provide for an extension in the length of the snaps*.

14. In a combination as set forth in claim 13, the snaps extending from each of the other two (2) faces in the beam being disposed in *a* spaced and parallel relationship to each other and being constructed to extend into *and through and past* the opening in the individual one of the particular faces of the block and to be retained within such opening and to be removed *through and* from such opening when a force is applied to obtain such removal*,*

*the flanges and the snaps being planar and substantially parallel*.

15. In a combination as set forth in claim 13,

*the block, the beam, the snaps and the flanges being made from a rigid material,* the block having openings in each of its six (6) faces, the openings communicating with one another, the snaps extending from one of the other two (2) faces in the beam into *and through and past* the opening in the individual one of the particular faces in the block having dimensions to provide for the insertion of corresponding snaps from other beams into *and through and past* the openings in the other faces in the block without any interference between the snaps in the openings in the block.

17. In a combination as set forth in claim 16,

*the block, the beam, the snaps and the flanges being made from a rigid material,* the portion providing the detent in each of the snaps having a bulbous shape to retain the snap within *and through and past* the opening in such face in the block.

18. In a combination as set forth in claim 17, the detent portion in each snap being shaped to facilitate the insertion of the snap into *and through and past* the opening in such face of the block, the retention of the snap in *and through and past* the opening in the face of the block and the withdrawal of the snap *through and* from the opening in the face of the block.

24. In a combination as set forth in claim 23, each of the walls in the block being defined by external and internal surfaces, each of the snaps in each of the beams *being planar and* having a detent shaped to facilitate the insertion of such detent into *and through and past* any one of the openings in the block, *and* past the internal surface in the wall having such opening, to retain such snap in *and through and past* such opening with the detent on the snap disposed internally of the internal surface of the wall having such opening and to facilitate the removal of such snap *through and* from such opening.

25. In a combination as set forth in claim 24, the detent in each snap having a first detent portion shaped to facilitate the insertion of the snap into *and through and past* the opening in the wall in the block and past the internal surface in the wall and the retention of the snap in *and through and past* the opening in the wall in the block and having a second detent portion shaped to facilitate the withdrawal of the snap *through and* from the opening in the wall of the block, the snaps extending from each of the two (2) faces in each of the beams being disposed in spaced and substantially parallel relationship to each other and being substantially identical, the two (2) walls having the snaps in each of the beams being oppositely disposed in the beam.

30. In a combination as set forth in claim 26, the first detent portion of each snap having a progressively [increasing] *decreasing* thickness with progressive distances from the face from which the snap extends, the second detent portion of each snap having a progressively [decreasing] *increasing* thickness with progressive distances from the face from which the snap extends, the first and second detent portions of each snap having a common boundary at their positions of substantially greatest thickness.

32. In a combination as set forth in claim 31, each of the snaps have rounded corners at the [positions] *opposite lateral extremities* of the detent portions in such snap to facilitate the removal of the [snaps] *snap through and* from the [openings] *opening* in the [faces] *face* of the [blocks] *block* by bending the [snaps] *snap* progressively from the [openings] *opening*.

* * * * *